US010121618B2

(12) United States Patent
Gweon et al.

(10) Patent No.: US 10,121,618 B2
(45) Date of Patent: Nov. 6, 2018

(54) STARTING KEY APPARATUS OF VEHICLE

(71) Applicant: Hyundai Motor Company, Seoul (KR)

(72) Inventors: Sang Hoon Gweon, Seoul (KR); Kyoung Taek Kwak, Gyeonggi-do (KR); Jinsang Chung, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 130 days.

(21) Appl. No.: 15/249,832

(22) Filed: Aug. 29, 2016

(65) Prior Publication Data

US 2017/0169970 A1 Jun. 15, 2017

(30) Foreign Application Priority Data

Dec. 15, 2015 (KR) ..... 10-2015-0178787

(51) Int. Cl.

| | |
|---|---|
| ***H01H 19/32*** | (2006.01) |
| ***H01H 27/06*** | (2006.01) |
| ***H01H 19/28*** | (2006.01) |
| ***F02N 11/08*** | (2006.01) |

(52) U.S. Cl.

CPC ..... *H01H 27/06* (2013.01); *F02N 11/087* (2013.01); *H01H 19/28* (2013.01); *H01H 19/32* (2013.01); *F02N 2011/0874* (2013.01); *H01H 27/063* (2013.01); *H01H 2027/066* (2013.01)

(58) Field of Classification Search

CPC ..... H01H 27/06; H01H 27/063; H01H 27/08; F02N 11/087; F02N 2011/0874

USPC ..... 200/61.58 R, 61.62, 61.64, 61.66–61.68, 200/61.7, 43.04, 43.08

See application file for complete search history.

(56) References Cited

U.S. PATENT DOCUMENTS 2,778,891 A * 1/1957 Jacobi ..... H01H 1/16 200/11 C
4,414,830 A * 11/1983 Maiocco ..... B60R 25/02128 70/186
4,884,423 A * 12/1989 Fancher ..... B60R 25/02144 70/248
4,987,756 A * 1/1991 Fancher ..... B60R 25/02126 70/186

(Continued)

FOREIGN PATENT DOCUMENTS

KR 100757247 B1 * 9/2007

OTHER PUBLICATIONS

KR 100757247 B1 translation.*

*Primary Examiner* — Felix O Figueroa
(74) *Attorney, Agent, or Firm* — Mintz Levin Cohn Ferris Glovsky and Popeo, P.C.; Peter F. Corless

(57) ABSTRACT

A starting key apparatus of a vehicle includes: a housing including a stopper protrusion at an inner wall of the housing; a starting key rotating part installed in an end of the housing and in which a starting key is inserted; an ignition switch installed at another end of the housing and configured to start an engine; and a connection shaft provided in the housing and configured to connect the starting key rotating part to the starting switch, wherein the connection shaft includes: a shaft body rotated based on a shaft; a blocking lever installed in a cut groove of the shaft body to be rotated based on a hinge shaft; and a spring configured to connect the shaft body to the blocking lever to provide an elastic force to the blocking lever.

4 Claims, 6 Drawing Sheets

(56) References Cited

U.S. PATENT DOCUMENTS 6,810,701 B2 * 11/2004 Lee ..... B60R 25/02126
70/186

* cited by examiner

STARTING KEY APPARATUS OF VEHICLE

CROSS-REFERENCE TO RELATED APPLICATION

This application claims under 35 U.S.C. § 119(a) the benefit of Korean Patent Application No. 10-2015-0178787 filed in the Korean Intellectual Property Office on Dec. 15, 2015, the entire contents of which are incorporated herein by reference.

BACKGROUND (a) Technical Field

The present invention relates to a starting key apparatus of a vehicle.

(b) Description of the Related Art

In general, a starting key device installed in a vehicle has an operation interval which is divided into a LOCK point, an ACC point, an ON point, and a START point. If a user leaves a starting key after moving the starting key to the START point to turn-on starting of the vehicle, a self-return operation where the starting key automatically returns to an ON point from the START point is performed. In order to fix a position of the starting key in each point, two steel balls supporting a spring included in a starting switch are inserted into a conductive groove of a housing.

However, during the self-return operation, when the starting key is excessively bounced, the starting key is moved to the ACC point through the ON point so that the starting of the vehicle is turned-off. In this case, the starting must be turned-on again, which can be an inconvenience.

In order to prevent the excessive bounce of the starting key, if an elastic force of a spring included in the starting switch is increased, there is a need for great force to rotate the starting key by operation intervals, which can increase inconvenience to the user.

The above information disclosed in this Background section is only for enhancement of understanding of the background of the invention and therefore it may contain information that does not form the prior art that is already known in this country to a person of ordinary skill in the art.

SUMMARY

The present invention provides a starting key apparatus of a vehicle having advantages of preventing starting from being turned-off during a self-return operation.

An exemplary embodiment of the present invention provides a starting key apparatus of a vehicle, including: a housing including a stopper protrusion at an inner wall of the housing; a starting key rotating part installed in an end of the housing and in which a starting key is inserted; an ignition switch installed at another end of the housing and configured to start an engine; and a connection shaft provided in the housing and configured to connect the starting key rotating part to the starting switch, wherein the connection shaft includes: a shaft body rotated based on a shaft; a blocking lever installed in a cut groove of the shaft body to be rotated based on a hinge shaft; and a spring configured to connect the shaft body to the blocking lever to provide an elastic force to the blocking lever.

When a distance between the hinge shaft of the blocking lever and a mass center of the blocking lever is a first interval, and a distance between the hinge shaft of the blocking lever and the spring is a second interval, if multiplication of a centrifugal force exerting influence upon the blocking lever and the first interval is greater than multiplication of an elastic force of the spring and the second interval, the blocking lever may protrude by the spring to make contact with the stopped protrusion.

The first interval may be greater than the second interval.

A first point, a second point, a third point, and a fourth point may be sequentially located in the housing, the first point corresponds to a LOCK point, the second point may correspond to an ACC point, the third point may correspond to an ON point, and the fourth point may correspond to a START point, and when the connection shaft is excessively rotated in a reverse direction from the fourth point and passes through the third point, the blocking lever may be bounced from the cut groove to make contact with the stopper protrusion.

The hinge shaft may be located in the cut groove.

A flat area of the blocking lever may become wider as the blocking level is located away from the hinge shaft.

DETAILED DESCRIPTION OF THE EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
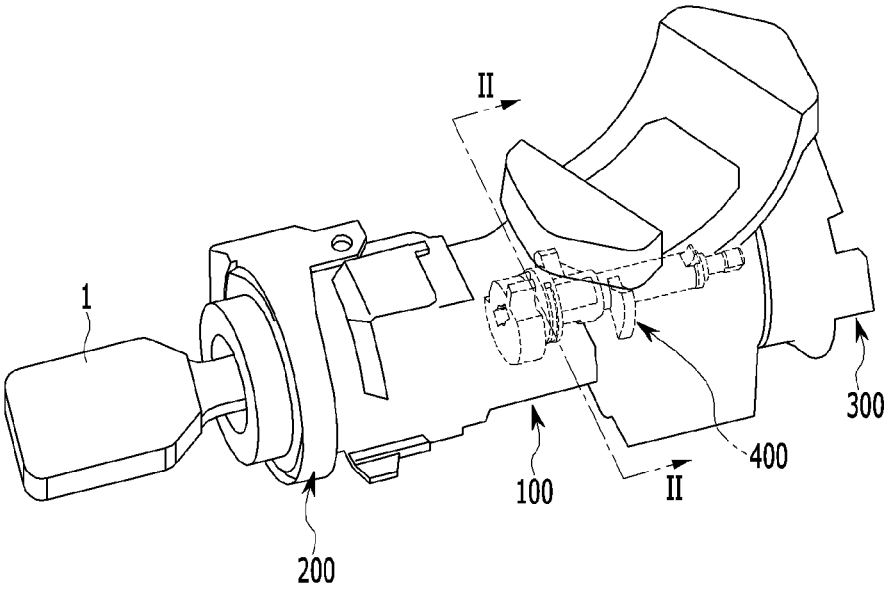
FIG. 1 is a perspective view illustrating a starting key apparatus of a vehicle according to an exemplary embodiment of the present invention.

FIG. 1 is a perspective view illustrating a starting key apparatus of a vehicle according to an exemplary embodiment of the present invention.

As shown in FIG. 1, the starting key apparatus includes a housing 100 having a substantially cylindrical bar shape, a starting key rotating part 200 installed in an end of the housing 100 and in which a starting key 1 is inserted, a starting switch 300 installed in another end of the housing 100 to start an engine of the vehicle, and a connection shaft 400 located inside the housing 100 to connect the starting key rotating part with the starting switch 300.

Hereinafter, a detailed structure of the starting key apparatus will be described with reference to FIG. 2, FIG. 3, and FIG. 4.

Figure 2:
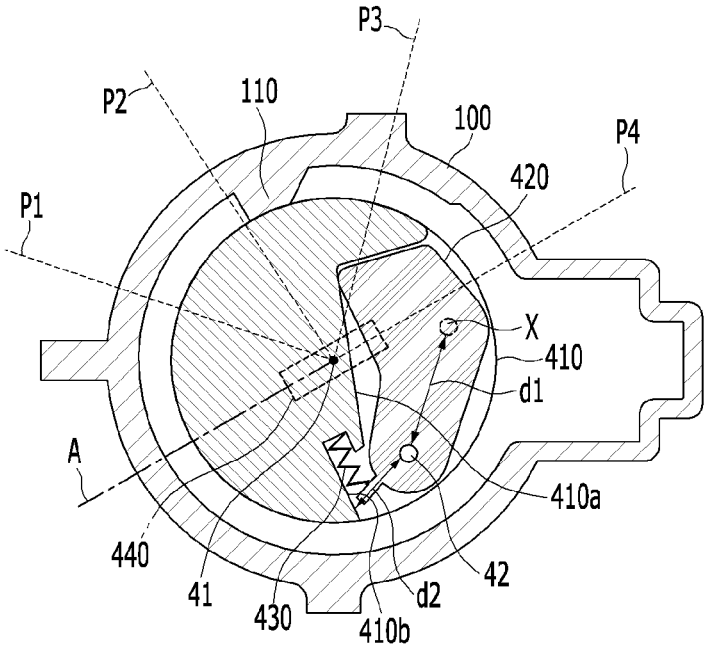
FIG. 2 is a cross-sectional view taken along line II-II of FIG. 1, which is a cross-sectional view where a starting key is located in a START point.
Figure 3:
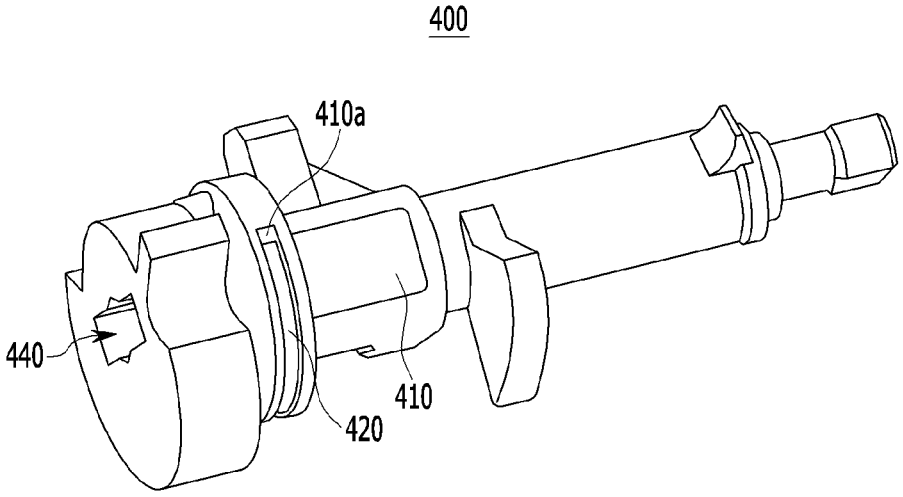
FIG. 3 is a front view illustrating a starting key rotating part of the starting key apparatus according to the exemplary embodiment of the present invention.
Figure 4:
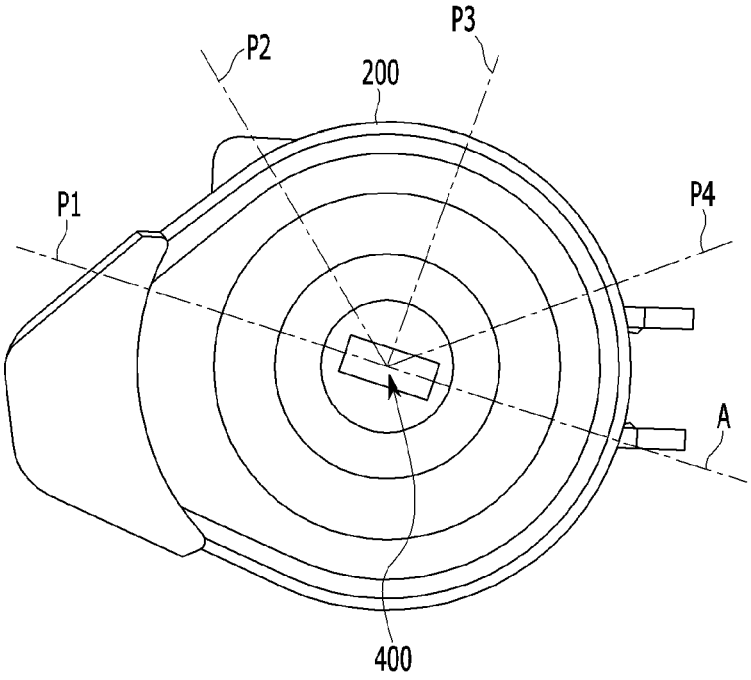
FIG. 4 is a perspective view illustrating a connection shaft of the starting key apparatus according to the exemplary embodiment of the present invention.

FIG. 2 is a cross-sectional view taken along line II-II of FIG. 1, which is a cross-sectional view where a starting key is located in a START point, FIG. 3 is a front view illustrating a starting key rotating part of the starting key apparatus according to the exemplary embodiment of the present invention, and FIG. 4 is a perspective view illustrating a connection shaft of the starting key apparatus according to the exemplary embodiment of the present invention.

As shown in FIG. 2 and FIG. 3, the housing 100 including a section having a substantially circular shape and an inner space. A protruded stopper protrusion 110 is formed in an inner wall of the housing 100.

A first point P1, a second point P2, a third point P3, and a fourth point P4 are sequentially located in the housing 100 clockwise. In case, the first point P1 corresponds to a LOCK point P1, the second point P2 corresponds to an ACC point P2, the third point P3 corresponds to an ON point P3, and the fourth point P4 corresponds to a START point P4. The stopper protrusion 110 blocks the shaft body 410 not to be rotated through the ON point P3. In the present exemplary embodiment, the stopper protrusion 110 is disposed between the ACC point P2 and the ON point P3. However, the present invention is not always limited thereto, and the position of the stopper protrusion 110 may be changed according to a shape of the blocking lever 420.

The connection shaft 400 includes a shaft body 410, the blocking lever 420 and a spring 430. The shaft body 410 is installed inside the housing to be rotated based on a shaft 41 which is a center of the shaft body 410. A cut groove 410*a* is formed in one side of the shaft body 410.

A cut groove 410*a* installed in the blocking lever 420 to be rotated based on a hinge shaft 42. The blocking lever 420 is fully inserted into the cut groove 410*a* and the hinge shaft 42 is located in the cut groove 410*a*.

The spring 430 is inserted into a spring groove 410*b* connected with the cut groove 410*a*. The spring 430 connects the blocking lever 420 to the shaft body 410, and provides an elastic force to the blocking lever 420.

As shown in FIG. 4, a LOCK point P1, an ACC point P2, an ON point P3 and a START point P4 are indicated in the starting key rotating part 200, respectively.

When a virtual extension line A of a starting key inserting part 440 corresponds to the LOCK point P1 by rotation of the starting key 1 inserted into the starting key inserting part 440, the whole power of the vehicle is turned-off. When a virtual extension line A of the starting key inserting part 440 corresponds to the ACC point P2, the starting of the vehicle is turned-off or power of attached devices such as an electronic device of the vehicle is turned-off. Further, when a virtual extension line A of the starting key inserting part 440 corresponds to the ON point P3, a starting on state of the vehicle is maintained. When the virtual extension line A of the starting key inserting part 440 corresponds to the START point P4, an engine of the vehicle is ignited.

If a user leaves a starting key 1 after the virtual extension line A of the starting key inserting part 440 is moved to the START point P4 to turn-off the starting of the vehicle, a self-return operation where the shaft body 410 is rotated based on the shaft 41 so that the virtual extension line A of the starting key insertion part 440 is automatically returned to the ON point P3 from the START point P4 is performed.

An operation of the starting key apparatus according to an exemplary embodiment of the present invention as described above will be described in detail with reference to FIG. 2, FIG. 5, and FIG. 6.

Figure 5:
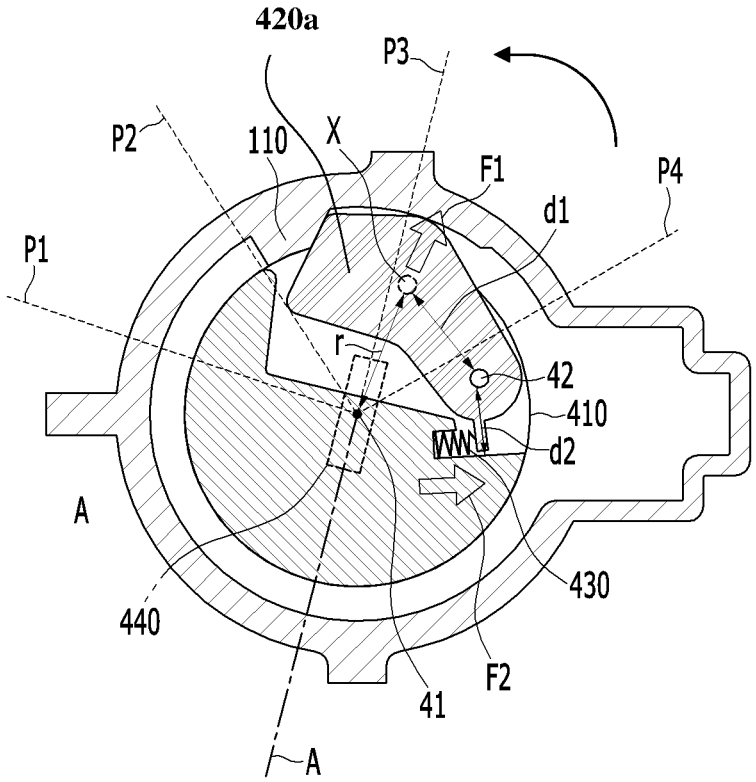
FIG. 5 is a cross-sectional view illustrating a state where a starting key is located in an ON point and a blocking level protrudes to be locked at a stopper protrusion in the starting key apparatus shown in FIG. 2.
Figure 6:
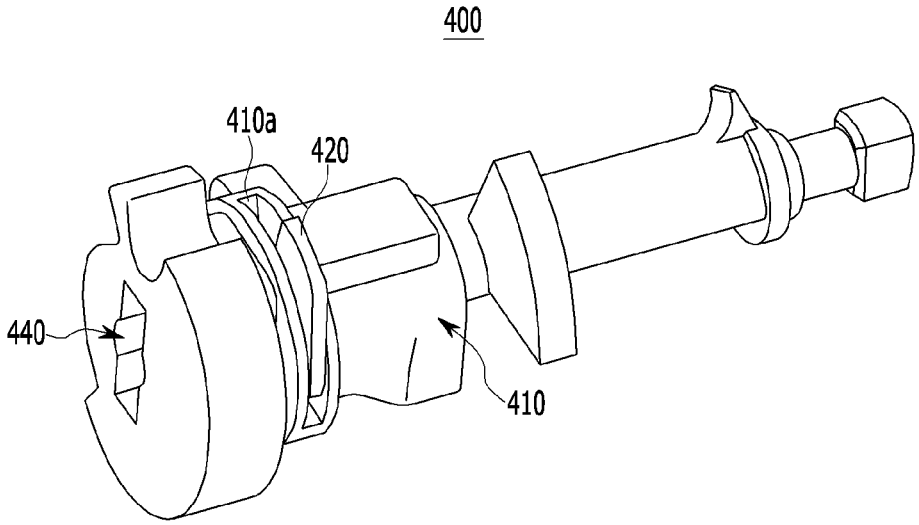
FIG. 6 is a perspective view illustrating a state where a blocking level protrudes from a connection shaft of the starting key apparatus according to the exemplary embodiment of the present invention.

FIG. 5 is a cross-sectional view illustrating a state where a starting key is located in an ON point and a blocking level protrudes to be locked at a stopper protrusion in the starting key apparatus of a vehicle shown in FIG. 2, and FIG. 6 is a perspective view illustrating a state where a blocking level protrudes from a connection shaft of the starting key apparatus according to the exemplary embodiment of the present invention. Hereinafter, for convenience of the description, it is defined that a distance between a hinge shaft 42 of the blocking lever 420 and a mass center (X) of the blocking lever 420 is a first interval d1, a distance between the hinge shaft 42 of the blocking lever 420 and a spring 430 is a second interval d2, a mass of the blocking lever 420 is m, a distance between the shaft 41 and the mass center (X) of the blocking lever 420 is r, and an angular velocity of the shaft body 410 is w.

First, as shown in FIG. 2, by inserting the starting key 1 into the starting key inserting part 440, and by rotating the starting key 1, the virtual extension line A of the starting key inserting part 440 corresponds to the START point P4 so that the engine of the vehicle is ignited.

Next, a self-return operation where a virtual extension line A of the starting key inserting part 440 is automatically returned to an ON point P3 from the START point P4 is performed so that a starting on state of the vehicle is maintained.

However, as shown in FIG. 5 and FIG. 6, during the self-return operation, a connection shaft 400 may be excessively rotated in a reverse direction from the START point P4 and pass through the ON point P3. In this case, multiplication of a centrifugal force F1 exerting influence upon the blocking lever 420 and the first interval d1 is greater than multiplication of an elastic force F2 of the spring 430 and the second interval d2, that is, F1×d1>F2×d2, the blocking lever 420 is bounced to an outside of the cut groove 410*a*.

Accordingly, the blocking lever 420 is locked at a stopper protrusion 110 is locked at the stopper protrusion 110 protruding to an inner wall of a housing 100. Therefore, an excessive reverse rotation of the shaft 400 may be blocked to prevent the starting of the vehicle from being turned-off.

In this case, a flat area 420*a* of the blocking lever 420 may become a wider shape as the blocking lever 420 is located away from the hinge shaft 42. In other words, the shape of the blocking lever 420 becomes wider further away from the hinge shaft 42. In this case, since a mass center(X) of the blocking lever 420 is spaced apart from the hinge shaft 42 as long as possible, the first interval d1 becomes greater than the second interval d2 so that the blocking lever 420 easily protrudes to an outside of the cut groove 410*a*.

Further, the blocking lever 420 may have a boomerang shape with a bent center. In this case, since a mass center (X) of the blocking lever 420 is spaced apart from the shaft 41 as long as possible, a centrifugal force F1 exerting influence upon the blocking lever 420 defined as $F1=m*r*w^2$ may be increased. As described above, the blocking lever 420 easily protrudes to an outside of the cut groove 410*a* by increasing the centrifugal force.

According to an exemplary embodiment of the present invention, when the starting key is excessively bounced, the starting key may be prevented from being moved to the ACC point by locking a blocking lever of a connection shaft at a stopper protrusion of a housing.

Accordingly, an excessive reverse rotation of the connection shaft may be prevented to prevent the starting of the vehicle from being turned-off.

As described above, the present invention was described with reference to the exemplary embodiment shown in the drawings. However, the present invention is not limited thereto. Various modified examples and other embodiments included in an equivalent range with the present invention are possible by those skilled in the art to which the invention pertains.

What is claimed is:

1. A starting key apparatus of a vehicle, comprising:

a housing including a stopper protrusion at an inner wall of the housing;

a starting key rotating part installed in an end of the housing and in which a starting key is inserted;

an ignition switch installed at another end of the housing and configured to start an engine; and a connection shaft provided in the housing and configured to connect the starting key rotating part to the starting switch, wherein the connection shaft comprises:

a shaft body rotated based on a shaft;

a blocking lever installed in a cut groove of the shaft body to be rotated based on a hinge shaft; and a spring configured to connect the shaft body to the blocking lever to provide an elastic force to the blocking lever, wherein when a distance between the hinge shaft of the blocking lever and a mass center of the blocking lever is a first interval, and a distance between the hinge shaft of the blocking lever and the spring is a second interval, wherein the blocking lever protrudes by the spring to make contact with the stopped protrusion when multiplication of a centrifugal force exerting influence upon the blocking lever and the first interval is greater than multiplication of an elastic force of the spring and the second interval, and wherein a first point, a second point, a third point, and a fourth point are sequentially located in the housing, the first point corresponds to a LOCK point, the second point corresponds to an ACC point, the third point corresponds to an ON point, and the fourth point corresponds to a START point, and when the connection shaft is excessively rotated in a reverse direction from the fourth point and passes through the third point, the blocking lever is bounced from the cut groove to make contact with the stopper protrusion.

2. The starting key apparatus of claim 1, wherein the first interval is greater than the second interval.

3. The starting key apparatus of a vehicle of claim 1, wherein:

the hinge shaft is located in the cut groove.

4. The starting key apparatus of a vehicle of claim 1, wherein:

a flat area of the blocking lever becomes wider as the blocking level is located away from the hinge shaft.

* * * * *